United States Patent [19]

Winkler et al.

[11] Patent Number: 4,819,765

[45] Date of Patent: Apr. 11, 1989

[54] ARRESTER DEVICE FOR ELEVATORS

[75] Inventors: Hugo Winkler, Vienna, Austria; Johannes De Jong, Jarvenpaa, Finland

[73] Assignee: Kone Elevator GmbH, Baar, Switzerland

[21] Appl. No.: 45,462

[22] Filed: May 4, 1987

[30] Foreign Application Priority Data

May 6, 1986 [FI] Finland ..... 861892

[51] Int. Cl.[4] ..... B66B 5/16

[52] U.S. Cl. ..... 187/88; 187/83; 188/43

[58] Field of Search ..... 187/88, 90, 93, 86, 187/80, 14; 188/43, 44, 67, 72.2, 73.45, 166

[56] References Cited

U.S. PATENT DOCUMENTS 3,509,970 5/1970 Gabler ..... 187/90
3,727,727 4/1973 Hauth ..... 188/72.2 X
3,869,024 3/1975 Hauth et al. ..... 188/72.2 X
4,240,529 12/1980 Hagmann et al. ..... 187/90

*Primary Examiner*—Joseph J. Rolla
*Assistant Examiner*—Stephen B. Parker
*Attorney, Agent, or Firm*—Sughrue, Mion, Zinn, Macpeak and Seas

[57] ABSTRACT

An arrester device, e.g. for an elevator cage or counterweight, has a wedge housing, an active wedge acting on one side of an elevator guide and activated by a separate transmission member, such as a rope, and a counterwedge acting on the elevator guide from the opposite side. The movements of the wedge and the counter wedge are directed to pass along inclined guide surfaces, the distance between the top margins of the guide surfaces being equal to or larger than the distance between their lower margins. The angle of inclination of the guide surfaces equals the wedge angles of the wedge and the counterwedge, respectively. Furthermore, the wedge housing comprises a force member, such as a spring, which exerts on the counterwedge a force substantially parallel to the respective guide surface.

4 Claims, 2 Drawing Sheets

ARRESTER DEVICE FOR ELEVATORS

FIELD OF THE INVENTION

The present invention relates to an arrestor device e.g. for an elevator cage or counterweight, the arrestor device comprising a wedge housing, an active wedge acting from one side on the elevator guide and which is activated by means of a separate transmission member, such as a rope, and a counterwedge acting on the elevator guide from the opposite side, the movements of the wedge and the counterwedge being directed along guide surfaces in the wedge housing.

BACKGROUND OF THE INVENTION

On elevators with a cage velocity over 1 m/s, slippage arrestor devices are usually employed as a safety measure in case for one reason or another, the velocity of the elevator cage increases so as to become excessively high. Slippage arrestor devices engage guides in the elevator shaft, which most usually number two or four. When each guide has a slippage arrestor device of its own, the arrestor devices are synchronized by means of a separate synchronizing linkage. The slip arrestor device has a slide surface having a high coefficient of friction, which is urged against the guide when the slippage arrestor device goes into action and slows the elevator down, or stops it, with the aid of friction.

Various designs of elevator arrestor devices have been elaborated. One of the commonest types is a large-sized, U-shaped spring made of spring steel, between the ends of which the wedge enters when it engages the guide. In addition, many arrestor devices feature a separate detachment wedge, with the aid of which the arrestor device is disengaged from the guide after arresting has occurred. Disengagement is effected by raising the elevator cage.

The greatest drawbacks of prior art arrestor devices are their high price and large size. The high price is due, among other things, to the circumstance that, for instance, the springs which are used are not standardized parts. A further drawback of previously known arrestor devices is a result of the variations of force occurring in connection with the arresting action, because the value of the coefficient of friction is different at different points along the guide, depending e.g. on the surface quality of the guide, the temperature of the friction material that is used, and the velocity of the elevator cage.

BRIEF SUMMARY OF THE INVENTION

It is an object of the present invention to provide an arrestor device for elevators in which the drawbacks mentioned above have been eliminated and with the aid of which several other advantages over prior art arrestor devices are, in addition, obtained.

According to the present invention, an elevator arrester device comprises an elevator arrester device comprising, a wedge housing, an active wedge operable at one side of an elevator guide in response to a separate transmission member, and a counterwedge acting on the elevator guide from the opposite side thereof, the wedge housing having a first guide surface for guiding the active wedge and a second guide surface for guiding the counterwedge, and the wedge housing including means for exerting on the counterwedge a force substantially parallel to the second guide surface.

The second guide surface is so inclined that the distance between the top margin of the second glide surface and the elevator guide is greater than the equivalent distance at the lower margin of the glide surface.

The distance between the top margins surface and the first and second guide surfaces equals or is larger than the distance between the lower margins of the guide surfaces, and the first and second guide surfaces have angles of inclination equals to the wedge angles of the active wedge and the counterwedge, respectively.

The distance between the top margins of the first and second guide surfaces is less than the distance between the lower margins of the first and second guide surfaces.

The force exerting means is preferably a spring.

Among the advantages the arrestor device according to the present invention over the arrestor devices of the prior art, it may be mentioned that the arrestor device of the present invention for use in a normal operating range utilizes expensive standard springs which, moreover, have less power than the springs required by the prior art. Furthermore, the arrestor device of the present invention affords the advantage that variations of the coefficient of friction at different points along the guide do not have such a great effect on the attainable frictional force as is the case in conventional arrestor devices. The present arrestor device is, in a sense, self-regulating.

BRIEF DESCRIPTION OF THE DRAWINGS

Further objects, features and advantages of the present invention will be apparent to those skilled in the art from the following description thereof given by way of example with reference to the accompanying drawings, in which.

DESCRIPTION OF THE PREFERRED EMBODIMENT

Figure 1:
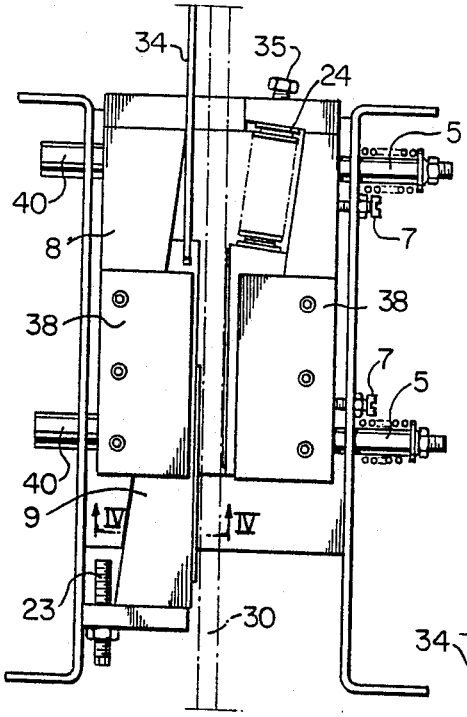
FIG. 1 shows an arrestor device according to the present invention, seen from the front.
Figure 2:
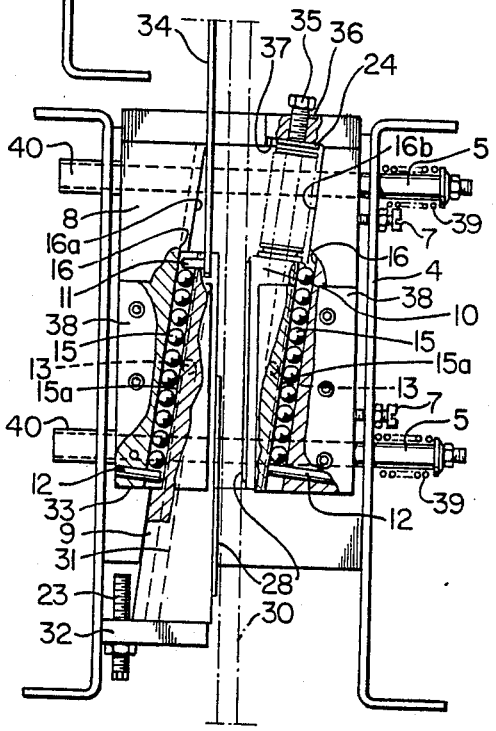
FIG. 2 shows the arrestor device of FIG. 1, partly broken-away in cross-section.
Figure 3:
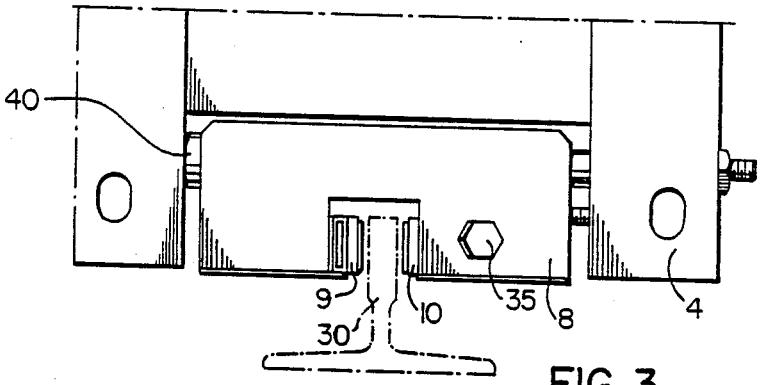
FIG. 3 shows the arrestor device of FIG. 1, seen from above and partly broken-away in cross-section.
Figure 4:
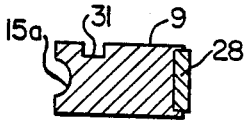
FIG. 4 shows a view of an active wedge, taken in cross-section along the line IV—IV of FIG. 1.
Figure 5:
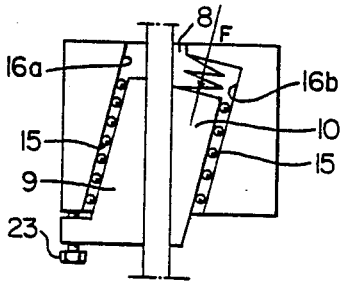
FIG. 5 shows the arrestor device of FIG. 1, seen from the front and simplified.

The arrestor device shown in the drawings comprises a wedge housing 8, which is secured in an arrestor device frame 4 by means of spring-loaded bolts 5. For lateral adjustment of the wedge housing 8, the arrestor device comprises adjustment screws 7, which are retained relative to the arrestor device frame 4.

The wedge housing 8 is so positioned in relation to an elevator guide 30 that the guide is located approximately centrally in the wedge housing, as seen from the front. On one side of the guide 30 there is located a guide surface **16*a* provided on the wedge housing 8 and on the other side there is located an equivalent guide surface 16*b*. Both guide surfaces 16*a* and 16*b* are inclined relative to the elevator guide 30, preferably so that both guide surfaces are parallel and so that the guide surface 16*b* is farther from the elevator guide 30 at its upper margin than at its lower margin. The angle of inclination depends on whether the elevator guides are lubricated or not. With lubricated guides, the angle of inclination is about 3° and with unlubricated guides it is about 8°. Active wedge 9 is displaceable along the guide surface 16***a* and the counterwedge 10 is displaceable along the guide surface 16*b*. Balls 15 are employed as friction-reducing elements between the guide surface and the wedge and counterwedge, whereby sliding friction is replaced by rolling friction. To enable the balls 15 to better maintain their intended positions, the guide surfaces have been provided with rolling grooves 16 each having a depth slightly less than the radius of the balls 15. Similarly, the surfaces of the wedge 9 and counterwedge 10 which face the wedge housing 8 are provided with similar rolling grooves 15*a*. The retention of the balls 15 in their rolling grooves is ensured by retainer cotter pins 12 in the wedge and the counterwedge at the lower ends of the grooves. At the top end of the groove 15, a similar retainer pin 11 is affixed to the wedge 9.

Both the active wedge 9 and the counterwedge 10 further present a guide groove 31 to retain them at proper distances from the wedge housing 8. The wedge housing is provided with retainer pins 13 having free ends projecting into the wedge guide grooves 31, thus preventing the active wedge and the counterwedge from moving too far out of contact with the wedge housing or falling from the wedge housing altogether. The vertical faces, running along the guide 30, of the active wedge 9 and the counterwedge 10 have been provided separate braking surfaces 28 which have better friction characteristics than the material from which the bodies of the wedge and counterwedge are made.

On the lower part of the active wedge 9 there is attached a separate adjustment plate 32, which faces the lower surface 33 of the wedge housing. The top end of the active wedge 9 is attached to a synchronizing rod 34 for simultaneous actuation of different arrestor devices.

Between the wedge housing 8 and the upper end of the counterwedge 10 there is interposed a compression spring 24, which pushes the counterwedge 10 obliquely downwardly. The compression spring 24 is secured in place by a securing bolt 35, which is fixed in the counterwedge 10 but may move in relation to the wedge housing through a hole 36, which has a diameter greater than the diameter of the securing bolt 35. A surface 37 in the wedge housing 8, against which the compression spring 24 acts, is so inclined that the spring force acting on the counterwedge 10 is parallel to the guide surface 16*b*. The wedge housing has, furthermore, guide plates 38, which prevent any potential lateral movement of the wedge and the counterwedge from the wedge housing and at the same time exclude unnecessary dirt and foreign particles from the wedge housing.

The operation of the above-described arrestor device according to the present invention is as follows:

When the downward velocity of the elevator cage increases so as to become too high, a velocity limiter (not shown in the drawings) is activated and acts on the arrestor device in such a way that the active wedge 9 is displaced upwardly relative to the wedge housing 8. As the elevator cage, and at the same time the wedge housing 8 move downwardly, the braking surface 28 of the active wedge 9 frictionally engages the elevator guide 30, whereby the active wedge 9 continues its relative upward movement in relation to the wedge housing 8.

The wedge housing 8 is therefore displaced laterally to the left, as depicted in FIG. 1, whereby at the same time the wedge housing 8 displaces the bolts 5 to the left with the aid of sleeves 40 attached to the bolts 5. The sleeves 40 move in holes provided in the arrestor device frame 4.

As a consequence of the lateral movement, the compression springs 39 on the bolts 5 are compressed and, furthermore, the braking surface 28 of the counterwedge 10 comes into contact with the elevator guide 30, whereby the relative upward movement in relation to the wedge housing 8 of both the active wedge and the counterwedge continues and the movement of the wedge housing continues to the left, until the adjustment screw 23 touches the lower surface 33 of the wedge housing.

When, after being arrested, the elevator is released by being raised, the movement is opposite and the springs 39 pull the wedge housing 8 back into position. The arrestor device is so adjusted that both the active wedge 9 and the counterwedge 10 contact the elevator guide 30 before the active wedge 9 stops in its top position. When the active wedge rises upwardly towards the limit of its top position, the counterwedge 10 also rises upwardly under the effect of friction the spring force F of the spring 24.

The frictional force between the wedge and counterwedge and the elevator guide 30 obtainable due to the wedging effect by the spring force F is very high, whereby the attainable braking power is high. When the wedge angle, and at the same time also the direction of the spring force relative to the elevator guide, has the magnitude $\alpha$, and considering the fact that owing to the ball bearing arrangement the frictional forces acting on the rear surfaces of the wedge and the counterwedge are nearly zero, the attainable frictional force can be calculated from the formula:

$$F_s = 2\mu F\left(\sin\alpha + \frac{\cos^2\alpha - \mu\sin\alpha\cos\alpha}{\sin\alpha + \mu\cos\alpha}\right)$$

The symbol $\mu$ represents the coefficient of friction between the elevator guide and the braking surfaces 28.

Figure 6:
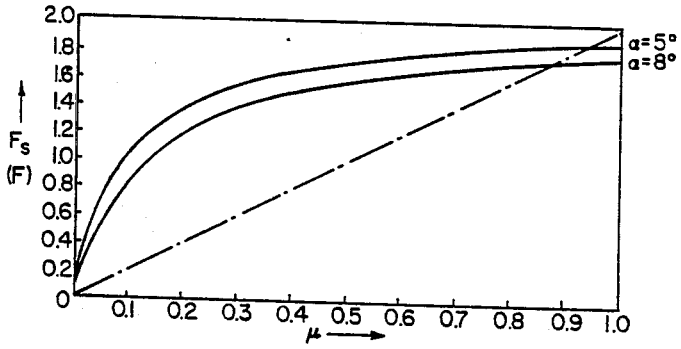
FIG. 6 graphically illustrates values of attainable frictional forces, plotted against the coefficient of friction.

FIG. 6 graphically illustrates the frictional forces found from the above formula for different values of the coefficient of friction. From the calculated results, two graphs have been plotted, one representing the results when the wedge angle is 5° and the other, when the wedge angle is 8°. For comparison, in the same connection has been plotted, with dot-and-dash lines, the frictional force obtainable with an arrestor device according to the state of art, relative to the coefficient of friction. The spring force is then usually parallel to the normal force, i.e. perpendicular to the elevator guide.

It is clearly seen from the graphs that, with values of the coefficient of friction below 0.85, clearly higher friction against the braking surface is achieved with the arrestor device embodying the invention that with conventional arrestor devices. Correspondingly, coefficients of friction higher than 0.85 are exceedingly difficult to attain.

From the foregoing, it follows, conversely, that with the arrestor device embodying the invention and using a spring of lower effect, the same frictional forces are obtained as with conventional arrestor devices using large, powerful, springs.

FIG. 6 also reveals the independence, better than in the case of conventional arrestor devices, of the arrestor device embodying the invention from variations in the coefficient of friction between different points along the elevator guide. The variation of coefficient of friction is influenced by the surface quality of the elevator guide at different points, the temperature of the friction material that is used, the velocity of the elevator cage, etc. Assuming that with the materials available a nominal coefficient of friction of $\mu=0.5$ is obtained between the elevator guide and the braking surfaces of the wedges, and that the variation of the coefficient of friction owing to various factors is $\pm 25\%$, the maximum of the coefficient of friction is then 0.3125 and the minimum is 0.1875. It can be seen from the graphs in FIG. 6 that, with conventional arrestor devices, the friction force $F_s=0.5\ \mu F$ is obtained, where F stands for the spring force.

Similarly, the maximum frictional force is 0.625 $\mu$F and the minimum is 0.375 $\mu$F. From these figures we can calculate that the variation of frictional force is the same as that of the coefficient of friction, i.e. $\pm 25\%$ of the nominal frictional force.

In the case of the arrestor device embodying the invention, calculation with the same values of coefficient of friction and of variation yields the following values, assuming that the wedge angle is 8°, the nominal friction force is 1.2929 $\mu$F, the maximum friction force is 1.3931 $\mu$F, and the minimum friction force is 1.544 $\mu$F. Hereby the variations of frictional force, related to nominal frictional force, are $-10.7\%$ and $-7.8\%$. Thus, we note that, when the arrestor device embodying the invention is used, the variation of braking force during an arrest of the elevator is substantially less than that encountered when conventional arrestor devices are used. The consequence is better, and more reliable, arresting than with arrestor devices conforming to the state of the art.

It will be apparent to those skilled in the art that the invention is not exclusively confined to the example presented in the foregoing and that, instead, different embodiments of the invention may vary within the scope of the appended claims.

We claim:

1. An elevator arrester device actuable to unidirectionally brakingly pinch engage opposite sides of an elongate vertical elevator guide member (30), comprising:

(a) a frame (4) disposed flanking the elevator guide member, (b) a wedge housing (8) disposed within the frame and displaceable laterally relative thereto, said housing defining first and second substantially parallel guide surfaces (16*a*, 16*b*) inclined at substantially equal but opposite acute sides thereof, respectively, (c) an active wedge (9) slideably displaceable parallel to the first guide surface and having a braking face frictionally engageable with one side of the elevator guide member, (d) a counterwedge (10) slideably displaceable parallel to the second guide member and having a braking face frictionally engageable with another, opposite side of the elevator guide member, (e) a compression spring (24) disposed between the housing and one end of the counterwedge for continuously urging the counterwedge in a direction substantially parallel to the second guide surface, (f) means (5, 39, 40) for biasing the housing laterally of the frame, and (g) means for selectively urging the active wedge in a direction parallel to the first guide surface such that the braking face thereof frictionally engages said one side of the elevator guide member, which attendantly displaces the housing laterally against the force of the biasing means to frictionally engage the braking face of the counterwedge with said opposite side of the elevator guide member and displace the counterwedge against the force of the compression spring to pinch the guide member between the braking faces.

2. Arrestor device according to claim 1, wherein said second guide surface is so inclined that the distance between the top margin of said second guide surface and said elevator guide is greater than the equivalent distance at the lower margin of said guide surface.

3. Arrestor device according to claim 1 wherein the distance between the top margins of said first and second guide surfaces equals or is larger than the distance first and second guide surfaces have angles of inclination equal to the wedge angles of said active wedge and said counterwedge, respectively.

4. Arrestor device according to claim 1 wherein the distance between the top margins of said first and second guide surfaces is less than the distance between the lower margins of said first and second guide surfaces.

* * * * *